US006269605B1

(12) United States Patent
Geiger

(10) Patent No.: US 6,269,605 B1
(45) Date of Patent: Aug. 7, 2001

(54) STONE STRUCTURE ASSEMBLY

(76) Inventor: Peter Geiger, Regensburgerstrasse 160, Neumarkt (DE), D-92318

( * ) Notice: Subject to any disclaimer, the term of this patent is extended or adjusted under 35 U.S.C. 154(b) by 0 days.

(21) Appl. No.: 09/230,692

(22) PCT Filed: May 26, 1998

(86) PCT No.: PCT/EP98/03087

§ 371 Date: Jan. 29, 1999

§ 102(e) Date: Jan. 29, 1999

(87) PCT Pub. No.: WO98/54414

PCT Pub. Date: Dec. 3, 1998

(30) Foreign Application Priority Data

May 30, 1997 (DE) ..... 197 22 676

(51) Int. Cl.[7] ..... E04B 5/04

(52) U.S. Cl. ..... 52/608; 52/603; 404/41; 404/38; 404/34

(58) Field of Search ..... 52/603, 608; 404/41, 404/38, 34

(56) References Cited

U.S. PATENT DOCUMENTS 5,028,167 * 7/1991 Scheiwiller ..... 404/41

FOREIGN PATENT DOCUMENTS 84 05 128 4/1984 (DE) .
87 15 158 1/1988 (DE) .
90 13 003 11/1990 (DE) .

* cited by examiner

*Primary Examiner*—Carl D. Friedman
*Assistant Examiner*—Christy M. Syres
(74) *Attorney, Agent, or Firm*—Collard & Roe, PC.

(57) ABSTRACT

The invention relates to a stone structure assembly, comprising a plurality of stones, especially concrete blocks, having similar height, upper and lower sides extending on parallel planes and vertical side walls. In order to place the thirteen stone blocks pertaining to said assembly in such a way that they cannot be displaced and that similarly narrow spacing gaps are formed in-between said stones, two stones are shaped as a prism with the same surface area and eleven stones are shaped as a trapezium with differing surface areas. The stones in the stone structure assembly are configured as a single piece with a bottom section and a top section set back from the peripheral surface of the base section at least in certain areas.

21 Claims, 4 Drawing Sheets

STONE STRUCTURE ASSEMBLY

BACKGROUND OF THE INVENTION

1. Field of the Invention

The invention relates to a stone structure assembly with a plurality of stones made in particular from concrete material and having the same height and upper and lower sides extending in parallel planes, as well as vertical side walls.

2. The Prior Art

A stone structure assembly formed by seven blocks is known (from DE design patent 84 05 128), which comprises rectangular and trapezoidal blocks. In the composite structure of said blocks it is possible to obtain a straight-line or a curved pattern of the laid blocks by lining up said blocks accordingly. If the blocks for the stone structure assembly are aligned in the form of an arc, joints are formed that become relatively wide toward the outer sides of the arc. Such joints make it more difficult to safely walk on such a composite structure. Furthermore, the blocks permit only few variations of the installed pattern. With another stone structure assembly, which is known as well (from DE design patent 90 13 003), the drawback of wide joints is avoided by exclusively employing trapezoidal blocks with equal legs of the trapezium. However, like the blocks of the first-mentioned stone structure assembly, said blocks have the drawback that they are spaced from each other in the installed pattern for forming joints, so that said blocks may get displaced. Such displacement results in an inharmonious pattern of the installed blocks and makes it difficult to drive on such a stone structure assembly.

SUMMARY OF THE INVENTION

The object of the invention is to create a stone structure assembly comprising blocks which can be laid free of displacement against each other, and which are suitable for forming uniform narrow spacing joints.

This object is achieved according to the invention in that thirteen blocks are arranged in the assembled composite structure, of which two blocks in the horizontal plane are shaped in the form of prisms having the same surface areas, and eleven blocks are shaped as trapezia with varying surface areas; and in that the blocks each are configured as single pieces each having a base section and a top section set back from the peripheral surface of the base section at least in certain areas.

The proposed number of blocks permits a variable pattern of the assembled structure, whereby in the installed composite structure, the base sections form abutting or supporting elements for adjacent blocks, such supporting elements being free of displacement—or being shiftable only to very minor degrees—and maintaining the top sections spaced from each other with permanent joint spacings. Supporting adjacent blocks by means of the base sections prevents displacement even under high loads and assures that uniform narrow joints are maintained with preferred widths of from 4 to 12 mm. The narrow joints so obtained permit safe walking on the installed set of blocks.

For forming the block assembly provision is made that the corner regions of the base and top sections are designed in the form of segments of a circle, and that said corner regions are disposed one on top of the other at least approximately equiaxed, and that the base section ends in the corner regions with segments of the side surfaces projecting beyond the top section. The roundings so obtained in the corner regions of the blocks prevent damage to said corner areas, for example damage caused due to squeezing between adjacent corner regions when the blocks are installed in the form of an arc, or when corner regions are subjected to uneven mechanical loads.

Furthermore, provision is made that the side surfaces of the base sections are substantially smooth-walled, and that the side surfaces of the top sections are irregularly corrugated with rounded deepenings and elevations. The result thereof is that the base sections safely support each other flatly irrespectively of their inclination relative to one another, whereas the top sections have the appearance of broken natural stones.

For the purpose of intensifying the appearance of natural stone, irregularly corrugated, rounded deepenings and elevations are preferably formed in the top sides of the top sections, or provision is made for top sections with embossed top sides. Furthermore, it was found to be advantageous if the top sides of the top sections or the latter as a whole are formed by dyed concrete material.

Finally, provision is made that a straight-lined installation of the blocks is obtained in the composite structure by lining up blocks with prismatically identical surface areas with blocks with trapezoidally uneven shapes and congruent association of the slanted surfaces. However, it is possible also to create by means of the blocks an arc-shaped composite structure by setting blocks with prismatically identical surface areas against the slanted surfaces of an equilegged trapezoidal block, and by setting the parallel top and bottom surfaces of trapezoidal blocks against said slanted surfaces. Therefore, the set of blocks can be employed in many different ways, and it is variable within its individual types of application.

According to a preferred design of the set of blocks, the angle of inclination of the slanted surfaces of the trapezoidally unequal blocks versus the fictitious planes extending transversely from the parallel side surfaces of the blocks is selected between 1°44' and 5°46'. It is understood that when the blocks are installed in the form of an arc, the angles of inclination become increasingly larger as the spacing from the center of the installed structure increases.

Furthermore, provision is made to design the blocks with a defined ratio of height between the top and the base sections. If was found that it is useful if the ratio of height between the top and base sections substantially amounts to 1:4 to 1:3. It is understood that other height ratios can be selected as well. For example, it is conceivable that the top section is designed with a lesser height and the base section with a correspondingly increased height.

BRIEF DESCRIPTION OF THE DRAWINGS

The invention is illustrated with the help of an embodiment shown in the drawing, in which.

DETAILED DESCRIPTION OF PREFERRED EMBODIMENTS

Figure 7:
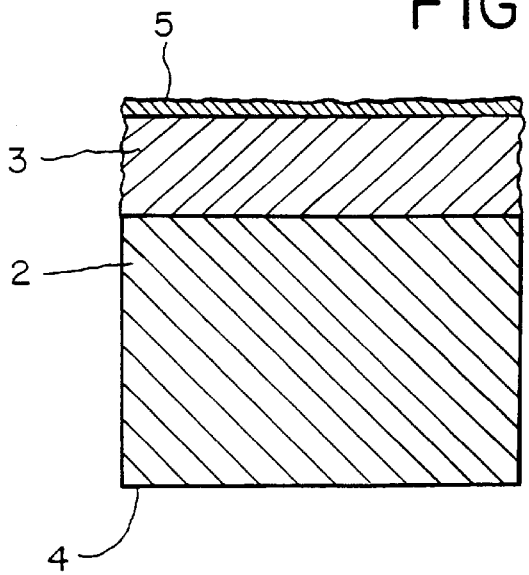
FIG. 7 is an enlarged sectional view of a block cut along line VII—VII of FIG. 1.

Block set 1 shown in the figures has thirteen blocks "G1, F1, E1, D1, C, A, B, B, C, Dr, Er, Fr, and Gr" made from concrete material. Blocks "G1, F1, E1, D1, C, A, B, B, C, Dr, Er, Fr and Gr" each are single pieces and each provided with a base section 2 and a top section 3, and have plane bottom surfaces 4 and parallel plane top surfaces 5. The side surfaces 6, 7, 8 and 9 of blocks "G1, F1, E1, D1, C, A, B, B, C, Dr, Er, Fr, and Gr" extend vertically, which is particularly visible in FIG. 7.

Figure 1:
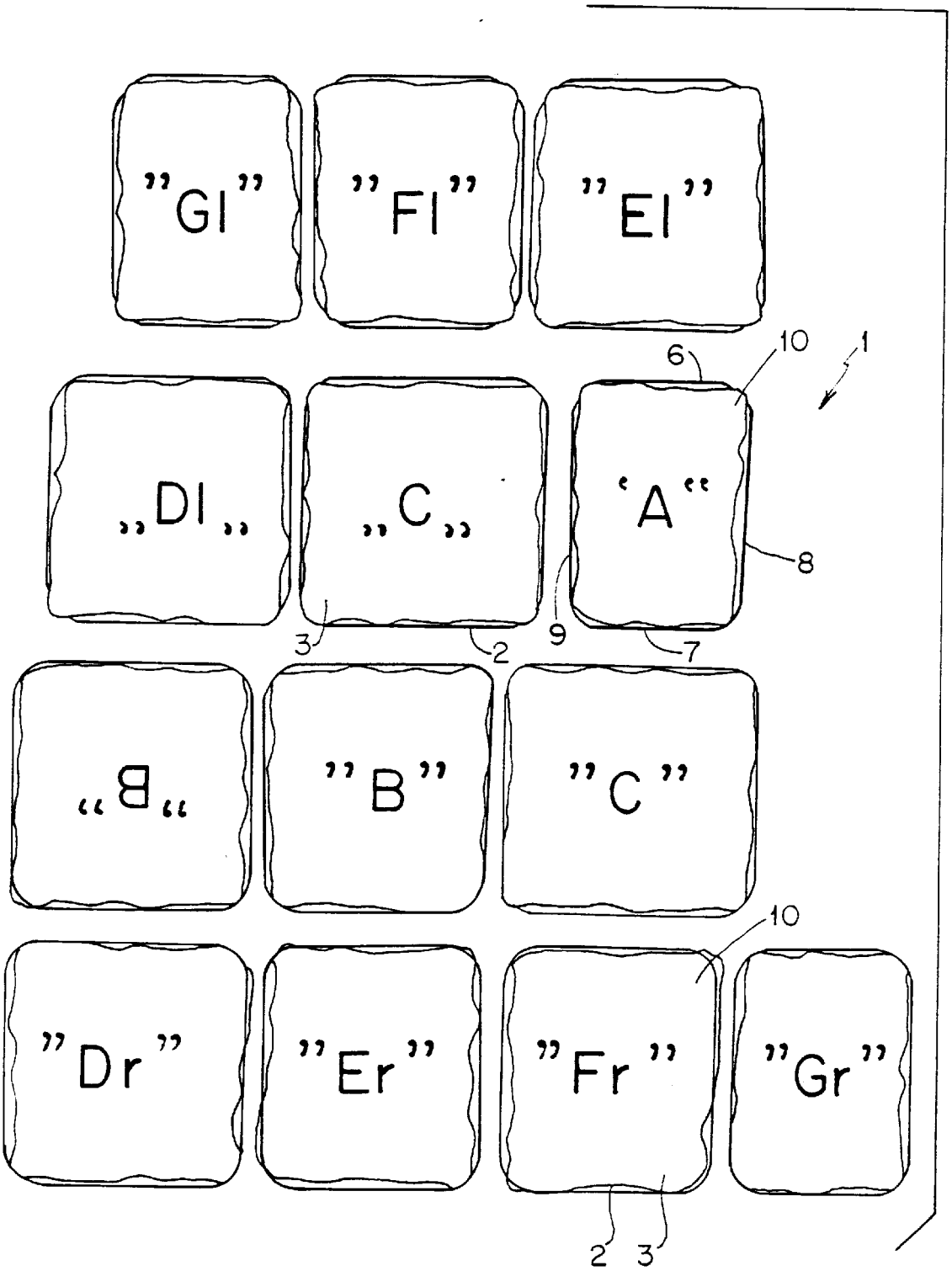
FIG. 1 shows a top view of a set of blocks comprising thirteen blocks.
Figure 2:
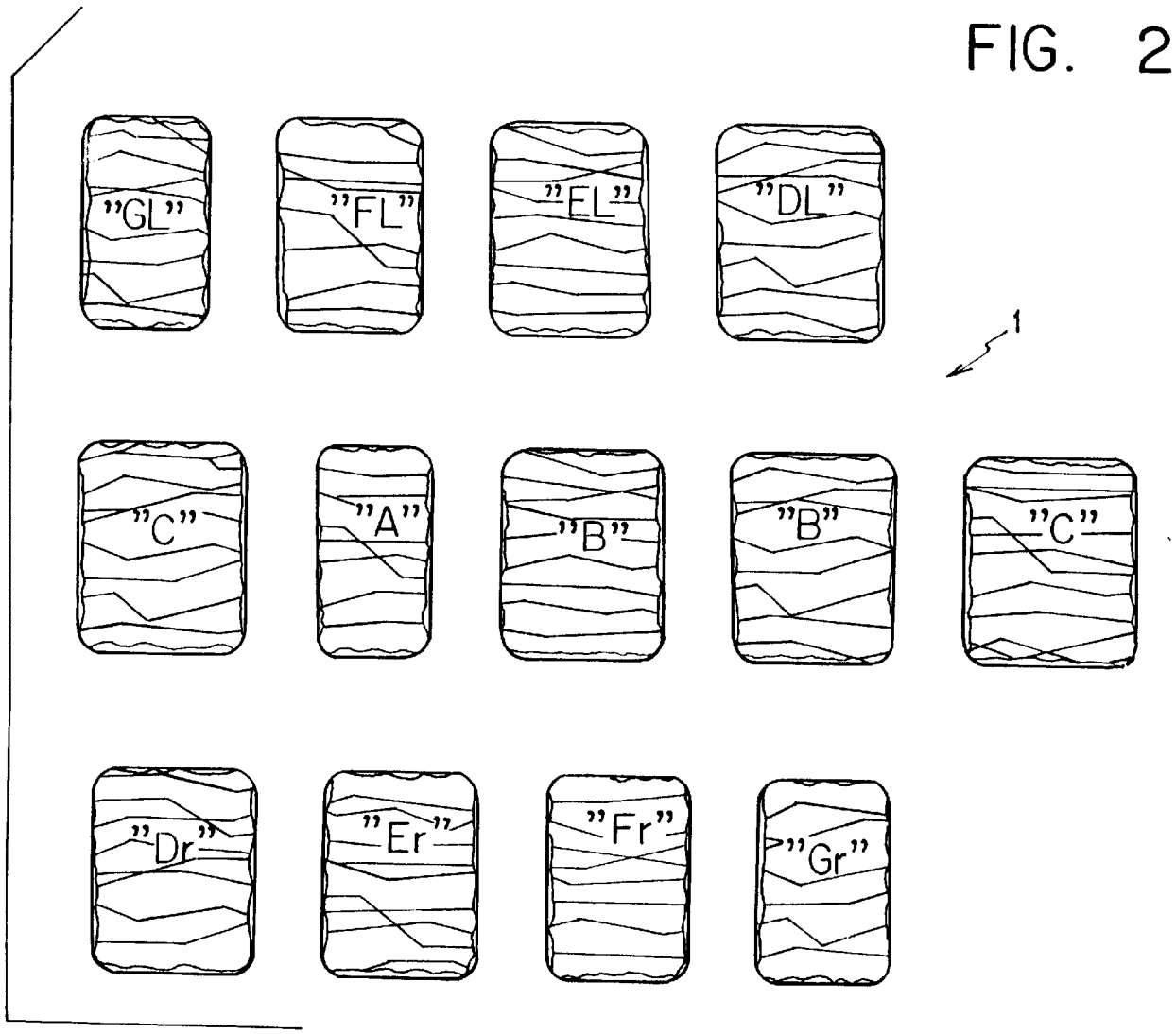
FIG. 2 is a top view of the reduced blocks true to scale.

The blocks C are substantially designed square with identical side lengths, whereas the blocks "G1, F1, E1, D1, A, B, Dr, Er, Fr and Gr" have horizontally a trapezoidal cross section. The base sections 2 of the blocks have smooth-walled side surfaces, whereas the side surfaces of the top sections 3 are provided with irregularly corrugated, rounded deepenings and elevations in order to impart in this way the impression of a natural stone. In addition, the top sides 5 of the blocks are either roughened or embossed or provided with irregularly corrugated, rounded deepenings and elevations, which supports the appearance of natural stone of the blocks. FIGS. 1 and 2 show, furthermore, that the top sections 3 and the base sections 2 of the blocks are designed with rounded corner regions 10, and that the side surfaces 6, 7, 8 and 9 of the base sections 2 project beyond the side surfaces of the top sections 3. Side surfaces 6, 7, 8, 9 extend into the rounded corner regions 10. In the vertical direction, blocks "G1, F1, E1, D1, C, A, B, B, C, Dr, Er, Fr and Gr" are designed with a height of about 8 cm, whereby the height of base sections 2 comes to about 6 cm, whereas the height of top sections 3 amounts to approximately 2 cm. It is understood that it is possible to employ deviations with respect to the height of the base and top sections. For example, it is possible to design top sections 3 with a greater or lesser height relative to base sections 2. Furthermore, provision is made to manufacture the top sides of top sections 3—or top sections 3 as a whole—from a dyed material in order to intensify in this way the appearance of natural stone.

Figure 5:
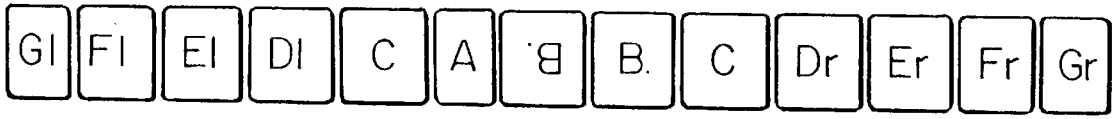
FIG. 5 shows a reduced view of a set of blocks laid in a straight line.
Figure 4:
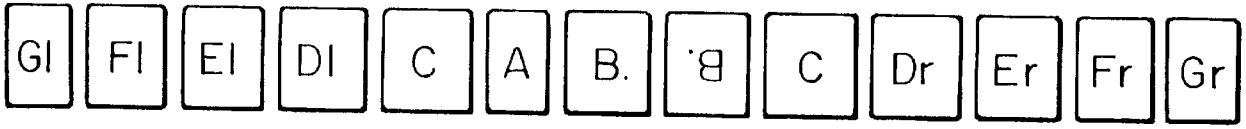
FIG. 4 shows a reduced top view of blocks set spaced from each other.

Among blocks "G1, F1, E1, D1, C, A, B, B, C, Dr, Er, Fr and Gr", the blocks denoted by letter "C" are designed with prismatically identical surface areas, whereas the other blocks arc designed trapezoidally with varying surface areas. Blocks "G1, Gr; F1, Fr; E1, Er; D1, Dr" each have a side surface 8 or 9 that is inclined versus the adjacent parallel surfaces 6, 7, whereby the inclination is designed with differently sized angles of inclination as shown in FIG. 2. The blocks "B" and "A" are designed in the form of equilegged trapezia viewed in the horizontal cross section, and the inclined surfaces are slanted only slightly. Blocks "G1, F1, E1, D1, C, A, B, B, C, Dr, Er, Fr and Gr" can be selectively set up next to one another as shown in FIG. 5, whereby for the purpose of forming approximately identical joint spacings across the entire pattern of the installed blocks, blocks having slanted surfaces are associated with each other congruently with their slanted surfaces, permitting straight-lined installation (FIG. 4).

Figure 3:
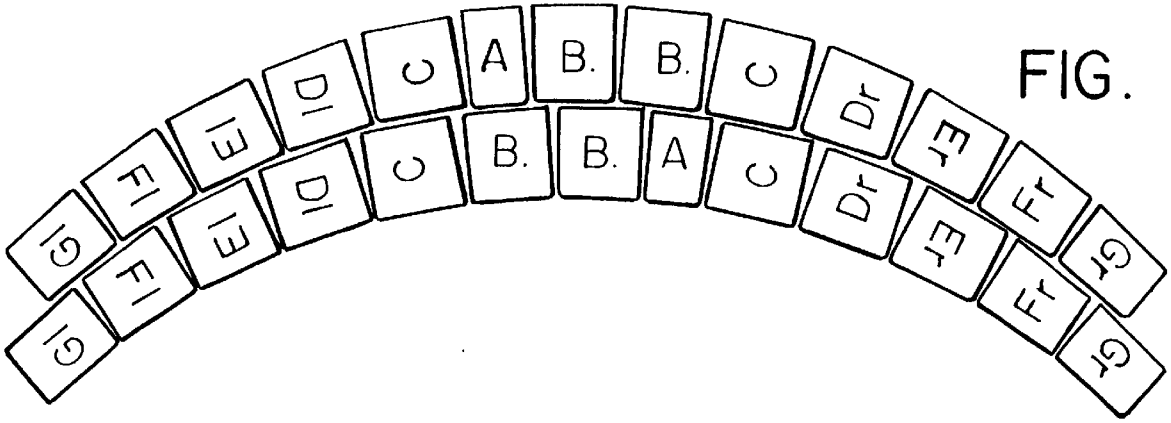
FIG. 3 shows a reduced top view of blocks installed in the form of an arc.

In FIG. 3, blocks "G1, F1, E1, D1, C, A, B, B, C, Dr, Er, Fr and Gr" are associated with one another in the form of a segment of a circle, whereby blocks "B" and "A" are installed upright, and blocks "G1 to C" and "Gr to C" are installed in lying positions. Due to such association, blocks "A, B and B" installed in upright positions support each other with the side surfaces of the associated base sections 2, and blocks "G1 to C" and "C to Gr" support each other one on top of the other with base sections 3 and top sections 3, effecting an association that is free of displacement, or subjected only to minor displacement, whereas the top sections 3 form the joints 12, which have a small width, so that it is possible to safely walk on said joints.

Figure 6:
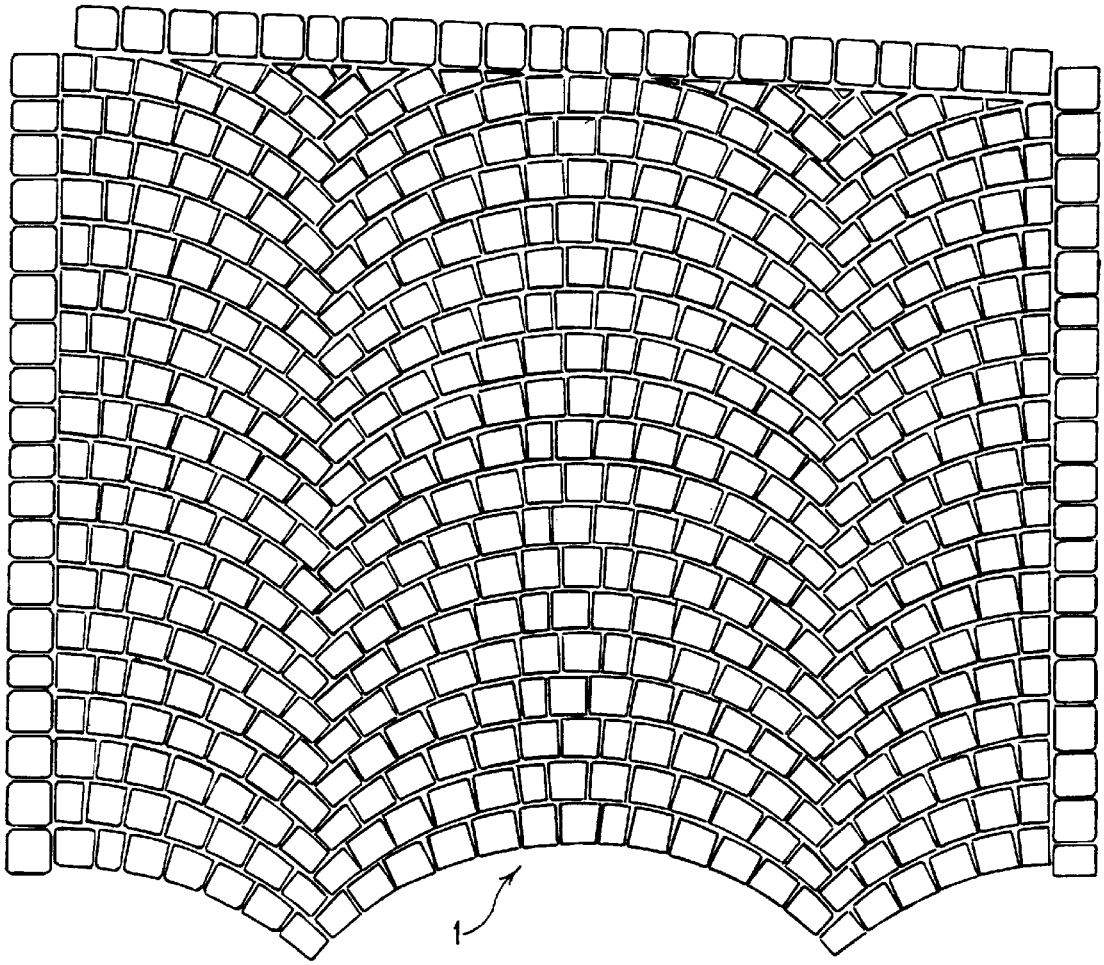
FIG. 6 is a reduced top view of an installation pattern with a larger number of sets of blocks laid in the form of arcs.

In the exemplified embodiment of FIG. 6, a great number of block sets 1 are installed in an arrangement in the form of a segment of a circle. Block sets 1 are laid analogous to the representation in FIG. 3.

Figure 8:
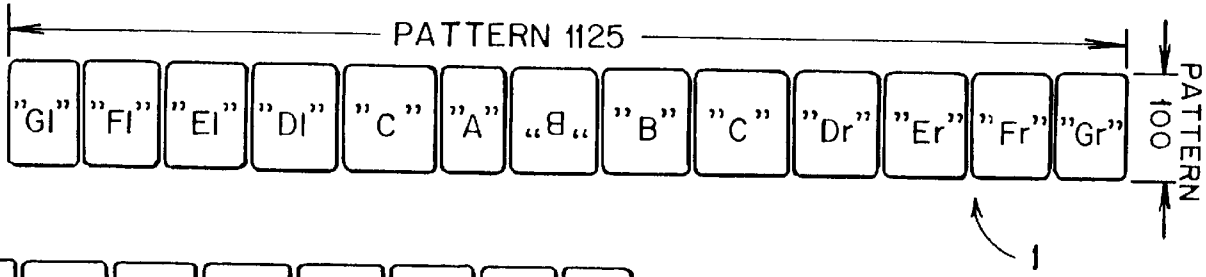
FIG. 8 is a top view of a set of blocks with blocks installed in a straight line, including data of the pattern.

FIG. 8 shows a block set 1 with blocks "G1, F1, E1, D1, C, A, B, B, C, Dr, Er, Fr and Gr" laid in a straight line, with allocation of the data of the pattern. In this connection, the measure of the pattern for the depth of the blocks amounts to 100 mm, whereas the measure of the pattern for the set of blocks laid in a straight line comes to 1125 mm. By associating the inclined trapezium sides of the trapezoidally shaped blocks with each other approximately equally sized joint widths are obtained, resulting in a harmonious installation pattern. The width of the joints is variable if the horizontal cross section of top sections 3 is selected smaller.

The following dimensional data are proposed for base sections 2 of blocks "G1, F1, E1, D1, C, A, B, B, C, Dr, Er, Fr and Gr".

| Blocks | Depth | Base length | Top length | Angle of inclination |
|---|---|---|---|---|
| G1 and Gr | 99 | 68 | 78 | 5°46' of one side surface |
| F1 and Fr | 99 | 77 | 85 | 4°37' of one side surface |
| E1 and Er | 99 | 85 | 91 | 3°28' of one side surface |
| D1 and Dr | 99 | 91 | 95 | 2°19' of one side surface |
| A | 99 | 82 | 88 | 1°44' of two side surfaces |
| B | 99 | 88 | 94 | 1°44' of two side surfaces |
| C | 99 | 96 | 96 | — |
| C | 99 | 96 | 96 | — |

It is in line with the idea of the invention that modifications are possible with respect to the dimensional ratios of the blocks and the inclinations of the side surfaces of trapezoidal blocks for forming modified installation patterns.

What is claimed is:

1. A stone structure assembly comprising thirteen paving stones (G1, F1, E1, D1, C, A, B., B•, C, Dr, Er, Fr, Gr) having the same heights and with parallel top and bottom sides, said paving stones being laid in a curved composite with each other, whereby the paving stones have a foot part (2) and a head part (3), the head part being recessed across sections vis-a-vis the side surfaces of the foot part (2); and the foot parts (2) in the composite form abutting and supporting bodies for adjacent paving stones and keeping the head parts (3) spaced from each other with the formation of joints;

two of said thirteen paving stones (C) arranged in a horizontal plane and being prismatically area-identical, and eleven of said thirteen paving stones (G1, F1, E1, D1, A, B., B•, Dr, Er, Fr, Gr) being trapezoidally area-unidentical; and wherein a straight-lined laying of the thirteen paving stones (G1, F1, E1, D1, C, A, B., B•, C, Dr, Er, Fr, Gr) is achieved by lining up the prismatically area-identical paving stones (C) with the trapezoidally area-nonidentical paving stones (G1, F1, E1, D1, A, B., B•, C, Dr, Er, Fr, Gr) with congruent association of slanted surfaces of the trapezoidally area-nonidentical paving stones.

2. The stone structure assembly according to claim 1, wherein the base sections (2) form displacement-free or low-displacement abutting and supporting elements for adjacent blocks; and that the top sections (3) are maintained by the base sections (2) with a permanent joint spacing (12) from each other.

3. The stone assembly structure according to claim 1, characterized in that the corner regions of the base and top sections (2; 3) are designed in the form of segments of a circle and are disposed at least approximately equiaxially one on top of the other; and that the base section (2) extends into the corner regions (10) with segments of the side surfaces projecting laterally beyond the top section (3).

4. The stone structure assembly according to claim 1, characterized in that the side surfaces of the base sections (2) are substantially smooth-walled, and the side surfaces of the top sections (3) are designed irregularly corrugated with rounded deopenings and elevations.

5. The stone structure assembly according to claim 1, characterized in that irregularly corrugated, rounded deepenings and elevations are formed in the upper sides of the top sections (3).

6. The stone structure assembly according to claim 5, characterized in that the upper sides of the top sections (3) are embossed, roughened.

7. The stone structure assembly according to claim 1, characterized in that the upper sides of the top sections (3) are formed by dyed concrete material.

8. The stone structure assembly according to claim 1, characterized in that the top sections (3) are wholly formed by a dyed material.

9. The stone structure assembly according to claim 1, characterized in that the height ratio of the top and base sections (3; 2) of the blocks relative to each other substantially amounts to from 1:4 to 1:3.

10. The stone structure assembly according to claim 1, wherein the stones (G1, F1, E1, D1, C, A, B., B•, Dr, Er, Fr, Gr) being shaped trapezoidally have differing surface areas with measurements between 1°44' and 5°46 '.

11. A stone structure assembly comprising:

thirteen paving stones (G1, F1, E1, D1, C, A, B., B•, C, Dr, Er, Fr, Gr) having the same heights and with parallel top and bottom sides, said paving stones being laid in a curved composite with each other, whereby the paving stones have a foot part (2) and a head part (3), the head part being recessed across sections vis-a-vis the side surfaces of the foot part (2); and the foot parts (2) in the composite form abutting and supporting bodies for adjacent paving stones and keep the head parts (3) spaced from each other with the formation of joints;

wherein two of said thirteen paving stones (C) are in a horizontal plane and are prismatically area-identical, and eleven of said thirteen paving stones (G1, F1, E1, D1, A, B., B•, Dr, Er, Fr, Gr) are trapezoidally area-unidentical; and wherein an arch-like composite is formed by installing the prismatically area-identical paving stones (C) against the slanted surfaces of an equally legged trapezoidal paving stone (A), and the trapezoidal paving stones (G1, F1, E1, D1, B., B•, Dr, Er, Fr, Gr) against each other, with the parallel head and foot surfaces against said paving stones and against one another.

12. The stone structure assembly according to claim 11, wherein the base sections (2) form displacement-free or low-displacement abutting and supporting elements for adjacent blocks; and that the top sections (3) are maintained by the base sections (2) with a permanent joint spacing (12) from each other.

13. The stone assembly structure according to claim 11, wherein the corner regions of the base and top sections (2; 3) are designed in the form of segments of a circle and are disposed at least approximately equi-axially one on top of the other; and that the base section (2) extends into the corner regions (10) with segments of the side surfaces projecting laterally beyond the top section (3).

14. The stone structure assembly according to claim 11, wherein the side surfaces of the base sections (2) are substantially smooth-walled, and the side surfaces of the top sections (3) are designed irregularly corrugated with rounded deepenings and elevations.

15. The stone structure assembly according claim 11, wherein irregularly corrugated, rounded deepenings and elevations are formed in the upper sides of the top sections (3).

16. The stone structure assembly according to claim 11, wherein the upper sides of the top sections (3) are embossed, roughened or the like.

17. The stone structure assembly according to claim 14, wherein upper sides of the top sections (3) are formed by dyed concrete material.

18. The stone structure assembly according to claim 14, wherein the top sections (3) are wholly formed by a dyed material.

19. The stone structure assembly according to claim 11, wherein an arc-shaped composite structure formed by setting blocks (C) with prismatically identical surface areas against the inclined surfaces of a block (A) with an equilegged trapezoidal shape, and by setting the parallel top and bottom surfaces of the trapezoidal blocks (G1, F1, E1, D1, Dr, Er, Fr, Gr) against said block (A).

20. The stone structure assembly according to claim 11, wherein the height ratio of the top and base sections (3; 2) of the blocks relative to each other substantially amounts to from 1:4 to 1:3.

21. The stone structure assembly according to claim 11, wherein the stones (G1, F1, E1, D1, C, A, B., B•, Dr, Er, Fr, Gr) being shaped trapezoidally have differing surface areas with the measurements between 1°44' and 5°46'.

* * * * *